US010352518B2

(12) United States Patent
Lee

(10) Patent No.: US 10,352,518 B2
(45) Date of Patent: Jul. 16, 2019

(54) LENS ASSEMBLY FOR IMPLEMENTING LOW BEAM

(71) Applicant: Hyundai Mobis Co., Ltd., Seoul (KR)

(72) Inventor: Hyun Soo Lee, Yongin-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 15/594,974

(22) Filed: May 15, 2017

(65) Prior Publication Data

US 2017/0336050 A1 Nov. 23, 2017

(30) Foreign Application Priority Data

May 17, 2016 (KR) ..... 10-2016-0060140

(51) Int. Cl.

| | |
|---|---|
| ***F21V 5/00*** | (2018.01) |
| ***F21V 7/00*** | (2006.01) |
| ***F21S 41/00*** | (2018.01) |
| ***F21V 7/04*** | (2006.01) |
| ***F21S 41/20*** | (2018.01) |
| ***F21S 41/265*** | (2018.01) |
| ***F21S 41/275*** | (2018.01) |
| *F21S 41/143* | (2018.01) |
| *F21S 43/00* | (2018.01) |

(52) U.S. Cl.

CPC ..... *F21S 41/00* (2018.01); *F21S 41/265* (2018.01); *F21S 41/275* (2018.01); *F21S 41/285* (2018.01); *F21V 5/007* (2013.01); *F21V 7/0083* (2013.01); *F21V 7/045* (2013.01); *F21S 41/143* (2018.01); *F21S 43/00* (2018.01); *F21V 5/00* (2013.01); *F21V 7/04* (2013.01)

(58) Field of Classification Search

CPC .... F21V 7/04; F21V 21/00; F21S 8/10; H01L 33/00

USPC ..... 362/612, 611, 545, 555, 800

See application file for complete search history.

(56) References Cited

U.S. PATENT DOCUMENTS

| | | | | |
|---|---|---|---|---|
| 2008/0316761 | A1* | 12/2008 | Minano | G02B 3/0068 362/518 |
| 2012/0065760 | A1* | 3/2012 | Yagi | G02B 27/0012 700/103 |
| 2013/0003401 | A1* | 1/2013 | Sekiguchi | F21S 41/338 362/517 |
| 2013/0100679 | A1* | 4/2013 | Lin | F21V 5/04 362/327 |
| 2016/0341389 | A1* | 11/2016 | Hoshino | F21S 48/14 |
| 2017/0045192 | A1* | 2/2017 | Peng | F21S 48/1216 |
| 2017/0130923 | A1* | 5/2017 | Nishimura | F21S 41/24 |
| 2017/0211771 | A1* | 7/2017 | Nishimura | F21S 48/125 |
| 2017/0336041 | A1* | 11/2017 | Mochizuki | B60Q 1/0011 |
| 2018/0328558 | A1* | 11/2018 | Okubo | F21S 41/275 |

* cited by examiner

*Primary Examiner* — Edwyn Labaze

(74) *Attorney, Agent, or Firm* — H.C. Park & Associates, PLC

(57) ABSTRACT

A lens assembly for implementing a low beam may include: a first lens including an incident surface having a shape enclosing a light emitting diode (LED), and an exit surface through which light of the LED exits in a direction perpendicular to the exit surface; and a second lens disposed on the exit surface of the first lens and configured to project the light of the LED that exits from the exit surface. The light of the LED that is projected through the second lens may form a low-beam pattern.

13 Claims, 7 Drawing Sheets

SIZE 30mm

SIZE 40mm

SIZE 80mm

LENS ASSEMBLY FOR IMPLEMENTING LOW BEAM

CROSS-REFERENCES TO RELATED APPLICATIONS

The present application claims priority from and the benefit of Korean Patent Application No. 10-2016-0060140, filed on May 17, 2016, which is hereby incorporated by reference for all purposes as if fully set forth herein.

BACKGROUND

Field

Exemplary embodiments relate to a lens assembly of a vehicle lamp, and more particularly, to a lens assembly for implementing a low beam of the vehicle lamp.

Discussion of the Background

In general, conventional vehicle lamps have used typical bulbs to provide lighting at night. A light emitting diode (LED) has a semi-permanent lifespan and excellent lighting performance, and has been used in lieu of the bulbs recently. The use of a lighting method with a plurality of optical modules has been increasing.

The above information disclosed in this background section is only for enhancement of understanding of the background of the invention concept and, therefore, it may contain information that does not form the prior art that is already known in this country to a person of ordinary skill in the art.

SUMMARY

Exemplary embodiments of the present invention provide a lens assembly for implementing a low beam which can substitute, when it is used in a vehicle lamp, for the functions of a reflective surface, a shield, etc. used in a conventional vehicle lamp to implement a low beam.

In one exemplary embodiment, a lens assembly for implementing a low beam may include: a first lens comprising an incident surface having a shape enclosing a light emitting diode (LED), and an exit surface through which light of the LED exits in a direction perpendicular to the exit surface; and a second lens disposed on the exit surface of the first lens and configured to project the light of the LED that exits from the exit surface. The light of the LED that is projected through the second lens forms a low-beam pattern.

The incident surface may include: a front incident surface disposed in front of the LED so that light of the LED is incident to and refracted through the front incident surface; and a side incident surface disposed on a side of the LED so that light of the LED is incident to and refracted through the side incident surface.

The front incident surface may be formed by depressing a central portion of one side of the first lens and is convex toward the LED.

The side incident surface may be coupled with the front incident surface, and an angle between the side incident surface and the front incident surface exceeds 90°.

The first lens may further comprise a reflective surface on which the light of the LED that passes through the side incident surface is reflected.

The reflective surface may comprise a first end coupled to the side incident surface, and a second end coupled to the exit surface.

The exit surface may be formed such that the light of the LED that passes through the front incident surface and the light of the LED that is reflected by the reflective surface exit in a direction perpendicular to the exit surface.

The side incident surface may include: a first side incident surface spaced apart from the LED by a predetermined distance; a second side incident surface disposed farther from the LED than the first side incident surface; and a third side incident surface disposed farther from the LED than the second side incident surface.

The first side incident surface, the second side incident surface, and the third side incident surface may have different heights based on the front incident surface.

The reflective surface may include: a first reflective surface coupled to the first side incident surface; a second reflective surface coupled to the second side incident surface; and a third reflective surface coupled to the third side incident surface.

The second lens may include: a first curved surface configured to transmit light of the LED to a first distribution area of the low-beam pattern; a second curved surface configured to transmit light of the LED to a second distribution area of the low-beam pattern; and a third curved surface configured to transmit light of the LED to a third distribution area of the low-beam pattern.

The first curved surface, the second curved surface, and the third curved surface may have different curvatures.

The first lens and the second lens may be made of polycarbonate.

According to a lens assembly for implementing a low beam in accordance with exemplary embodiments, if the lens assembly is used in a vehicle lamp, it substitutes for the functions of a reflective surface and a shield which have been used in a conventional vehicle lamp to implement a low beam. Therefore, the number of optical parts of the vehicle lamp is reduced, so that the size of the vehicle lamp is reduced, various requirements in design of the vehicle lamp can be satisfied, and the production cost can be reduced.

Furthermore, even if portion of a second lens is damaged, the other portions of the second lens may compensate for a corresponding light distribution area of a low-beam pattern that has a reduced quantity of light. Consequently, the optical efficiency of the vehicle lamp can be improved.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the inventive concept and are incorporated in and constitute a part of this specification, illustrate exemplary embodiments of the invention, and together with the description serve to explain the principles of the inventive concept.

DETAILED DESCRIPTION OF EXEMPLARY EMBODIMENTS

Figure 1:
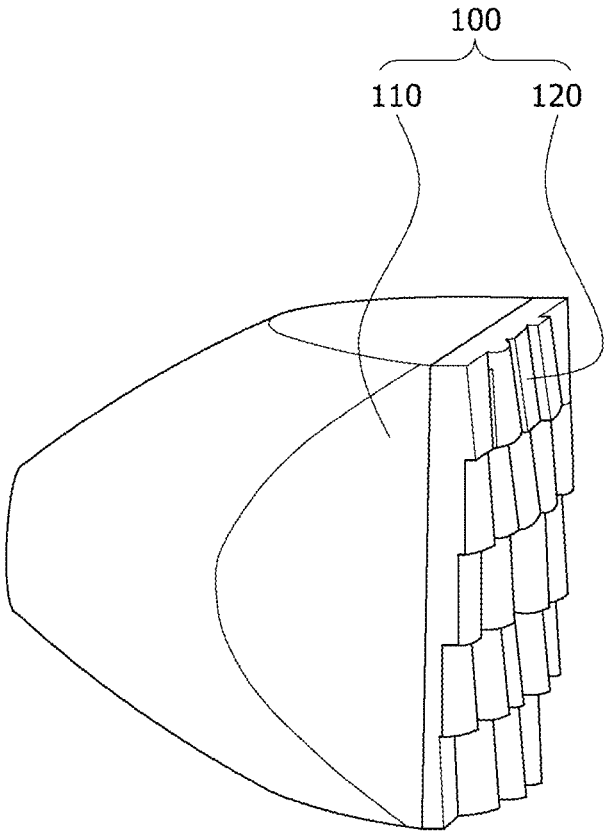
FIG. 1 is a perspective view illustrating a lens assembly for implementing a low beam in accordance with an exemplary embodiment.

Hereinafter, a lens assembly for implementing a low beam in accordance with exemplary embodiments will be described in detail with reference to the accompanying drawings. Throughout the specification, like reference numerals denote like elements having the same or similar functions. Detailed description of components or functions apparent to those skilled in the art will be omitted for clarity. It should be understood that the following exemplary embodiments are provided by way of example and that the present invention is not limited to the exemplary embodiments disclosed herein and can be implemented in different forms by those skilled in the art. It should be noted that the drawings are not to precise scale and may be exaggerated in thickness of lines or sizes of components for descriptive convenience and clarity only.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It should be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless defined otherwise, it is to be understood that all the terms (including technical and scientific terms) used in the specification has the same meaning as those that are understood by those who skilled in the art. Further, the terms defined by the dictionary generally used should not be ideally or excessively formally defined unless clearly defined specifically. It will be understood that for purposes of this disclosure, "at least one of X, Y, and Z" can be construed as X only, Y only, Z only, or any combination of two or more items X, Y, and Z (e.g., XYZ, XYY, YZ, ZZ). Unless particularly described to the contrary, the term "comprise", "configure", "have", or the like, which are described herein, will be understood to imply the inclusion of the stated components, and therefore should be construed as including other components, and not the exclusion of any other elements.

A LED vehicle lamp generally includes an LED light source, a reflector, a shield, an aspheric lens, etc., and emits light generated from the LED light source to an area in front of the vehicle through the reflector, the shield, and the aspheric lens. The LED vehicle lamps may be designed to implement a low beam or a high beam so as to increase the visibility of the area in front of the vehicle.

Research has become more active on an improved lens design method for reducing the size of an optical system applied to a vehicle lamp and enhancing the efficiency of the system and on a technology for meeting various design requirements using application of the lens design method.

In order to implement a certain beam pattern, there is a need for developing a lens capable of substituting for the functions of the reflector and the shield used in the conventional optical system for vehicle lamps, which makes it possible to reduce the size of the optical system, enhance the efficiency of the optical system, and satisfy various design requirements.

Figure 2:
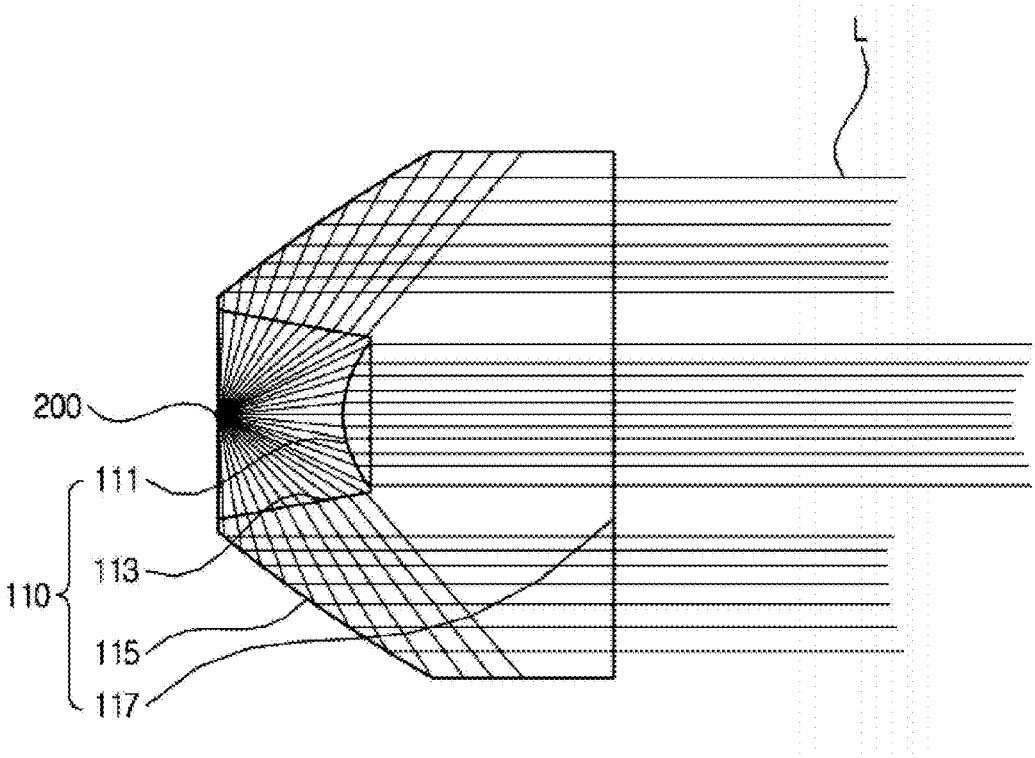
FIG. 2 is a sectional view illustrating a first lens of the lens assembly in accordance with an exemplary embodiment.
Figure 3:
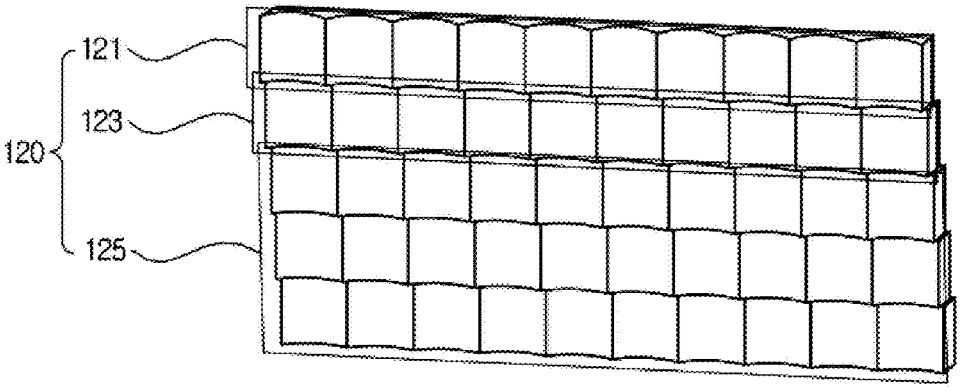
FIG. 3 is a front view illustrating a second lens of the lens assembly in accordance with an exemplary embodiment.

Referring to FIG. 1, FIG. 2 and FIG. 3, a lens assembly 100 for implementing a low beam in accordance with an exemplary embodiment includes a first lens 110 and a second lens 120.

The first lens 110 may include a front incident surface 111 and a side incident surface 113, a reflective surface 115, and an exit surface 117 through which light L generated from the LED 200 exits. The front incident surface 111 and the side incident surface 113 are configured in a shape enclosing a light emitting diode (LED) 200. The second lens 120 is disposed on the exit surface 117 of the first lens 110 so as to project the light L of the LED 200 that is emitted in a direction perpendicular to the exit surface 117. The light L of the LED 200 that has been projected by the second lens 120 implements a low-beam pattern.

If the lens assembly 100 is used in a vehicle lamp, it substitutes for the functions of a reflective surface and a shield which have been used in a conventional vehicle lamp to implement a low beam. Therefore, the number of optical parts of the vehicle lamp is reduced so that the size of the vehicle lamp is reduced, various requirements in design of the vehicle lamp can be satisfied, and the production cost can be reduced.

Referring to FIG. 2, when the light L emitted from the LED 200 in all directions is incident to the first lens 110, the first lens 110 makes the light L exit therefrom in any one direction. The front incident surface 111 is formed by depressing a central portion of one side of the first lens 110 and disposed in front of the LED 200 so that light L of the LED 200 can be incident to and refracted through the front incident surface 111. The front incident surface 111 is preferably convex toward the LED 200.

Beams of the light L of the LED 200 that are refracted and have passed through the front incident surface 111 move parallel to each other toward the exit surface 117.

The side incident surface 113 is formed along with the front incident surface 111 by depressing the central portion of the one side of the first lens 110 and disposed on a side of the LED 200 so that the light L of the LED 200 can be incident to and refracted through the side incident surface 113.

The side incident surface 113 is coupled with the front incident surface 111. The angle between the side incident surface 113 and the front incident surface 111 preferably exceeds 90°. The light L of the LED 200 that is refracted and has passed through the side incident surface 113 moves toward the reflective surface 115.

The reflective surface 115 is a surface on which the light L of the LED 200 that has passed through the side incident surface 113 is reflected. The reflective surface may comprise a first end and a second end. The first end of the reflective surface 115 may be coupled to the side incident surface 113, and the second end of the reflective surface 115 which extends from the first end may be coupled to the exit surface 117.

The reflective surface 115 may have a curvature such that beams of the light L of the LED 200 move parallel to each other toward the exit surface 117 after being reflected by the reflective surface 115. That is, if the light L entering the first lens 110 through the side incident surface 113 reaches the reflective surface 115, the light L is totally reflected by the reflective surface 115 and then moved toward the exit surface 117.

The exit surface 117 is a surface through which the light L that has entered the first lens 110 finally exits the first lens 110. The exit surface 117 basically has a circular shape, but may have a partially-cut circular shape. In this exemplary embodiment, the exit surface 117 may have a partially-cut circular shape corresponding to the shape of the second lens 120.

The light L of the LED 200 that has passed through the front incident surface 111 and the light L of the LED 200 that has been reflected by the reflective surface 115, may exit in a direction perpendicular to the exit surface 117.

The light L that has exited the first lens 110 through the exit surface 117 passes through the second lens 120 and implements a low-beam pattern.

Figure 4:
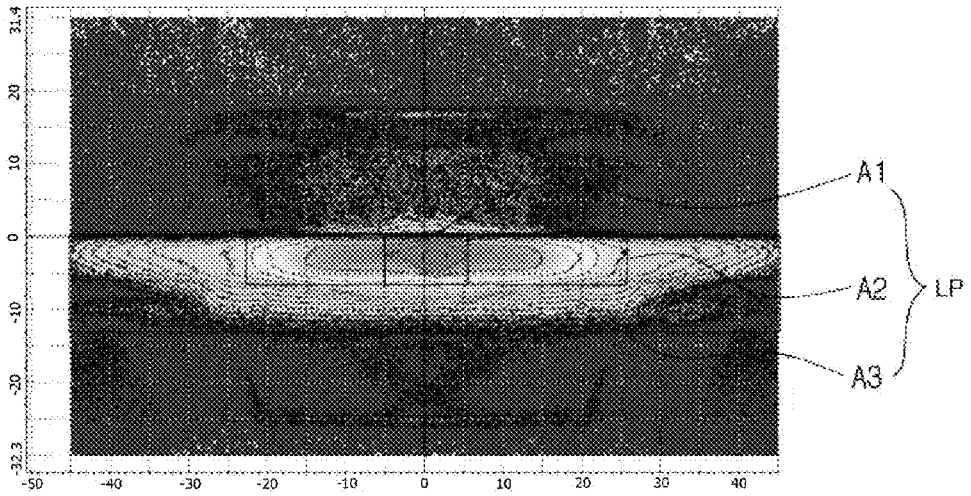
FIG. 4 is a diagram illustrating a low-beam pattern implemented by the lens assembly in accordance with an exemplary embodiment.

Referring to FIG. 3 and FIG. 4, the second lens 120 disposed on the exit surface 117 of the first lens 110 may project the light L of the LED 200 which has exited from the exit surface 117 and make the light L of the LED 200 implement a low-beam pattern LP.

The second lens 120 may include a first curved surface 121 and/or a plurality of first curved surfaces 121, a second curved surface 123 and/or a plurality of second curved surfaces 123, and a third curved surface 125 and/or a plurality of third curved surfaces 125. A plurality of first curved surface 121 may transmit light L of the LED 200 to a first light distribution area Al of the low-beam pattern LP. A plurality of second curved surface 123 may transmit light L of the LED 200 to a second light distribution area A2 of the low-beam pattern LP. A plurality of third curved surfaces 125 may transmit light L of the LED 200 to a third light distribution area A3 of the low-beam pattern LP.

The first curved surface 121, the second curved surface 123, and the third curved surface 125 may have different curvatures. Each of the first curved surface 121, the second curved surface 123, and the third curved surface 125 may have a concave shape. Based on the foregoing illustrated shape of the second lens 120, even if portion of the second lens 120 is damaged, the other portions of the second lens 120 may compensate for a corresponding light distribution area of the low-beam pattern that has a reduced quantity of light. Therefore, the optical efficiency of the vehicle lamp can be improved.

The second lens 120 has a shape capable of minimizing chromatic aberration.

The first lens 110 and the second lens 120 may be formed of polycarbonate (PC) material. Since the polycarbonate material has characteristics in which the chromatic aberration excessively increases, it has been difficult to apply polycarbonate material to the conventional optical system. The first lens 110 and the second lens 120 in accordance with an exemplary embodiment have shapes capable of minimizing occurrence of the chromatic aberration, which makes it possible to manufacture the first and second lens 110 and 120 using polycarbonate material.

Because the lens assembly 100 in accordance with an exemplary embodiment can be made of polycarbonate material which can be easily changed in shape, the manufacturing process of the lens assembly becomes easy and the production cost can be reduced.

To clearly implement the low-beam pattern LP of FIG. 4, there is the need for more specifically sectioning the first lens 110.

Figure 5:
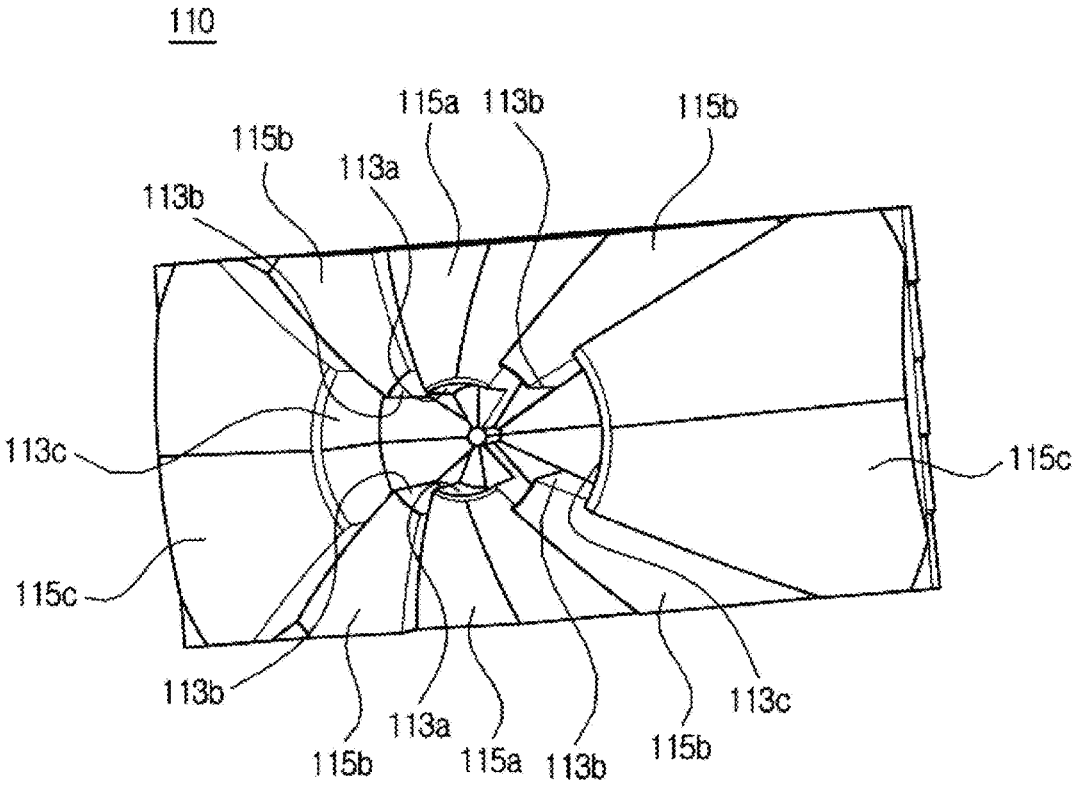
FIG. 5 is a front view illustrating the first lens of the lens assembly in accordance with an exemplary embodiment.

Referring to FIG. 5, the side incident surface 113 of the first lens 110 may be sectioned into a first side incident surface 113*a* which is spaced apart from the LED 200 by a predetermined distance, a second side incident surface 113*b* which is disposed farther from the LED 200 than the first side incident surface 113*a*, and a third side incident surface 113*c* which is disposed farther from the LED 200 than the second side incident surface 113*b*.

The first side incident surface 113*a*, the second side incident surface 113*b*, and the third side incident surface 113*c* may have different heights based on the front incident surface 111.

The reflective surface 115 may be sectioned into a first reflective surface 115*a* which is coupled to the first side incident surface 113*a*, a second reflective surface 115*b* which is coupled to the second side incident surface 113*b*, a third reflective surface 115*c* which is coupled to the third side incident surface 113*c*.

The light L which passes through the first and second lenses 110 and 120 having the above-mentioned shapes may clearly implement the low-beam pattern LP of FIG. 4.

Figure 6:
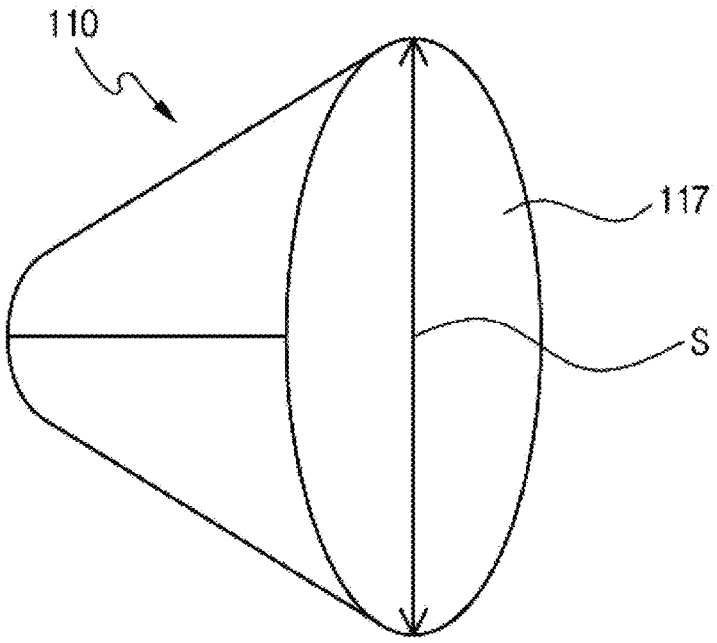
FIG. 6 is a view illustrating the first lens of the lens assembly before it is machined in accordance with an exemplary embodiment.

Referring to FIG. 6, the first lens 110 is illustrated before it is machined in a shape corresponding to the shape of the second lens 120.

Figure 7A:
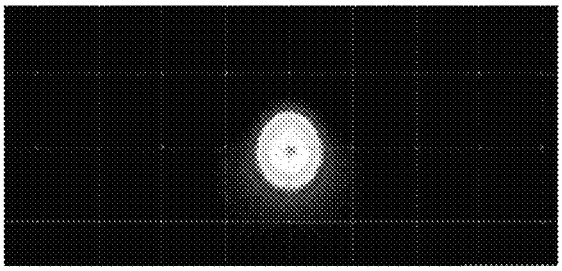
FIG. 7A, FIG. 7B and FIG. 7C are views illustrating a beam pattern implemented by light passing through the first lens of FIG. 6.
Figure 7B:
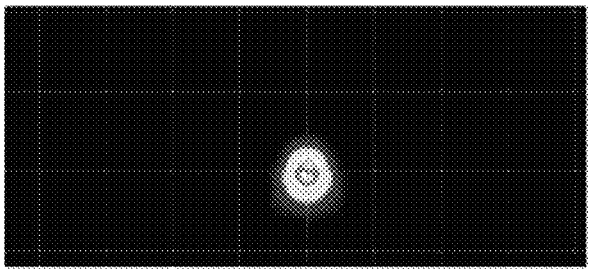
Figure 7C:
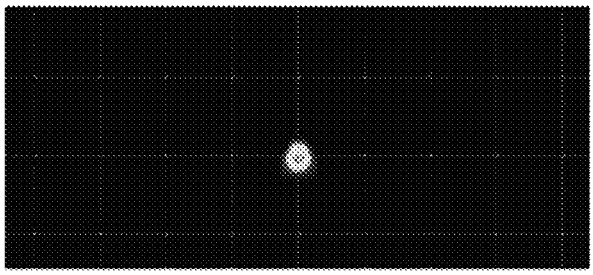

Referring to FIG. 7A, FIG. 7B, and FIG. 7C, examples are illustrated to show a change in pattern of a beam that has passed through the first lens 110 of FIG. 6 depending on a diameter S of the exit surface 117.

When the diameter S of the exit surface 117 of FIG. 6 is 30 mm, the beam pattern shown in FIG. 7A is formed. When the diameter S of the exit surface 117 of FIG. 6 is 40 mm, the beam pattern shown in FIG. 7B is formed. When the diameter S of the exit surface 117 of FIG. 6 is 80 mm, the beam pattern shown in FIG. 7C is formed.

The beam pattern of FIG. 7A shows that a distinct cut-off line is not formed when light L of LED 200 which has passed the lens assembly 100 implements a low-beam pattern. On the other hand, the beam patterns of FIG. 7B and FIG. 7C show that distinct cut-off lines are formed.

Therefore, it is preferable that the diameter of the exit surface 117 of the first lens 110 be set within a range from 40 mm to 80 mm before it is machined in a shape corresponding to the shape of the second lens 120.

In accordance with an exemplary embodiment, the lens assembly 100 can be used in a vehicle lamp to substitute for the functions of a reflective surface and a shield which have been used in the conventional vehicle lamp to implement a low beam. Therefore, the number of optical parts of the vehicle lamp is reduced so that the size of the vehicle lamp is reduced, various requirements in design of the vehicle lamp can be satisfied, and the production cost can be reduced.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A lens assembly for implementing a low beam, comprising:

a first lens comprising an incident surface having a shape enclosing a light emitting diode (LED), an exit surface through which light of an LED exits in a direction perpendicular to the exit surface, the incident surface further comprises a side incident surface disposed on a side of the LED so that the light of the LED is incident to and refracted through the side incident surface; and a second lens disposed on the exit surface of the first lens and configured to project the light of the LED that exits from the exit surface, wherein the light of the LED that is projected through the second lens forms a low-beam pattern, and wherein the first lens is separate from the second lens.

2. The lens assembly of claim 1, wherein the incident surface comprises:

a front incident surface disposed in front of the LED so that the light of the LED is incident to and refracted through the front incident surface.

3. The lens assembly of claim 2, wherein the front incident surface is formed by depressing a central portion of one side of the first lens and is convex toward the LED.

4. The lens assembly of claim 3, wherein the side incident surface is coupled with the front incident surface, and an angle between the side incident surface and the front incident surface exceeds 90°.

5. The lens assembly of claim 2, wherein the first lens further comprises a reflective surface on which the light of the LED that passes through the side incident surface is reflected.

6. The lens assembly of claim 5, wherein the reflective surface comprises a first end coupled to the side incident surface, and a second end coupled to the exit surface.

7. The lens assembly of claim 5, wherein the exit surface is formed such that the light of the LED that passes through the front incident surface and the light of the LED that is reflected by the reflective surface exit in the direction perpendicular to the exit surface.

8. The lens assembly of claim 5, wherein the side incident surface comprises:

a first side incident surface spaced apart from the LED by a predetermined distance;

a second side incident surface disposed farther from the LED than the first side incident surface; and a third side incident surface disposed farther from the LED than the second side incident surface.

9. The lens assembly of claim 8, wherein the first side incident surface, the second side incident surface, and the third side incident surface have different heights based on the front incident surface.

10. The lens assembly of claim 9, wherein the reflective surface further comprises:

a first reflective surface coupled to the first side incident surface;

a second reflective surface coupled to the second side incident surface; and a third reflective surface coupled to the third side incident surface.

11. The lens assembly of claim 1, wherein the second lens comprises:

a first curved surface configured to transmit the light of the LED to a first distribution area of the low-beam pattern;

a second curved surface configured to transmit the light of the LED to a second distribution area of the low-beam pattern; and a third curved surface configured to transmit the light of the LED to a third distribution area of the low-beam pattern.

12. The lens assembly of claim 11, wherein the first curved surface, the second curved surface, and the third curved surface have different curvatures.

13. The lens assembly of claim 1, wherein the first lens and the second lens are made of polycarbonate.

* * * * *